US007539436B2

(12) United States Patent
Yokoyama

(10) Patent No.: US 7,539,436 B2
(45) Date of Patent: May 26, 2009

(54) IMAGE FORMING APPARATUS PROVIDED WITH A COOLING MECHANISM FOR COOLING PORTIONS

(75) Inventor: Shuji Yokoyama, Izunokuni (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 115 days.

(21) Appl. No.: 11/676,554

(22) Filed: Feb. 20, 2007

(65) Prior Publication Data

US 2007/0196122 A1 Aug. 23, 2007

(30) Foreign Application Priority Data

Feb. 20, 2006 (JP) ..... 2006-042767

(51) Int. Cl.
*G03G 21/20* (2006.01)

(52) U.S. Cl. ..... 399/92; 399/341

(58) Field of Classification Search ..... 399/92, 399/94, 320, 341
See application file for complete search history.

(56) References Cited

U.S. PATENT DOCUMENTS 6,374,063 B1 * 4/2002 Todome ..... 399/92 X
2004/0091281 A1 * 5/2004 Kimizuka ..... 399/92
2004/0189777 A1 * 9/2004 Sugiura et al. ..... 347/104
2005/0008389 A1 * 1/2005 Kim et al. ..... 399/92
2006/0269314 A1 * 11/2006 Lee et al. ..... 399/92
2007/0019981 A1 * 1/2007 Kawamata ..... 399/92
2007/0059023 A1 * 3/2007 Koshida ..... 399/92
2007/0059024 A1 * 3/2007 Kitayama ..... 399/92
2007/0071485 A1 * 3/2007 Yuasa ..... 399/92

FOREIGN PATENT DOCUMENTS

JP 04-257880 9/1992
JP 11-030891 2/1999
JP 11-231760 A * 8/1999
JP 2001-013856 A * 1/2001
JP 2002-333814 11/2002
JP 2003-270884 9/2003

* cited by examiner

*Primary Examiner*—Sophia S Chen
(74) *Attorney, Agent, or Firm*—Amin, Turocy & Calvin, LLP

(57) ABSTRACT

An image forming apparatus is provided with a cooling mechanism mechanism having an air-cooling fan and a cooling duct for guiding cooling air from this air-cooling fan to desired positions to be cooled. A plurality of rectangular holes are formed in the longitudinal direction of the cooling duct. Positions of the rectangular holes are not located directly above the respective paper delivery rollers and are slightly shifted from the paper delivery rollers toward the rear side. On the front side of the cooling duct there are formed an opening for discharging cooling air toward the ADU and an opening for discharging cooling air toward the rear side of the control panel operated by a user.

9 Claims, 5 Drawing Sheets

IMAGE FORMING APPARATUS PROVIDED WITH A COOLING MECHANISM FOR COOLING PORTIONS

CROSS-REFERENCE TO RELATED APPLICATION

This application is based upon and claims the benefit of priority from prior Japanese Patent Application No. 2006-042767 filed on 20 Feb. 2006, the entire content of which is incorporated herein by reference.

BACKGROUND OF THE INVENTION

1. Field of the Invention

The present invention relates to an image forming apparatus, and in particular to an image forming apparatus provided with a cooling mechanism for cooling portions which are very likely to be handled by users.

2. Description of the Related Art

In an image forming apparatus, sheet of paper is heated at the time of fixing. Subsequently the paper is cooled when it is fed and is then delivered. However, if sufficient time is not secured between the fixing and delivery, the paper is insufficiently cooled and delivered with high temperature. Particularly, in an image forming apparatus having a fixing and a delivery unit closely arranged, paper delivery temperature is a serious issue.

So, it is effective to reduce the temperature of delivered sheets of paper to provide a paper cooling mechanism in order to compensate for insufficient cooling time.

For cooling the delivered sheets of paper, for example, in a paper folding apparatus, stacking sheets of toner heat-fusing continuous printing paper having folding perforated lines on a table with the front and back side thereof being folded one after the other, detecting the front side of sheets of paper stacked on the table by means of a sensor, and lowering the table by a certain degree, it has been proposed to provide a plurality of pairs of blowers and ducts for supplying cooling air to the sheets of paper and to arrange the ducts in a longitudinal direction of the sheets of paper respectively for blowing strong and weak air from the ducts (for example, Jpn. Pat. Appln. Laid-Open Publication No. 2003-270884)

However, conventionally, when air-cooling a sheet of paper to be delivered, cooling air was blown to the entire sheet of paper, therefore, a sheet of paper may be delivered with high-temperature portions thereof not insufficiently cooled. In particular, a fixing unit becomes very hot during a fixing operation. As a result, temperature of the periphery of the fixing unit is obviously very high. For example, if image forming is repeated many times, the temperature of the photographic fixing unit reaches 160 to 170° C. If no cooling is performed, a paper delivery roller mounted on the outlet side of the fixing unit and a delivered sheet of paper reach about 100° C. If a sheet of paper is maintained at such a high temperature, there occur problems such as stripes of the paper delivery roller left on a formed image and the like. Further, the high temperature portions are not cooled immediately, and therefore, a user may come into contact with the hot portions when removing a jammed sheet of paper and the like.

BRIEF SUMMARY OF THE INVENTION

It is an object of the present invention is to provide an image forming apparatus performing cooling so that the entire sheet of paper has an equal temperature distribution and being provided with a cooling mechanism for cooling a plurality of portions where users are very likely to handle.

In an aspect of the present invention, the image forming apparatus includes an air-cooling fan and a cooling duct for guiding cooling air from the air-cooling fan to desired positions to be cooled. In the cooling duct, a discharge port thereof for blowing cooling air to a sheet of paper to be delivered on which an image has been formed is formed large in the vicinity of the center of the paper width and is formed small in the vicinity of the both ends of the paper width.

DETAILED DESCRIPTION OF THE INVENTION

Figure 1:
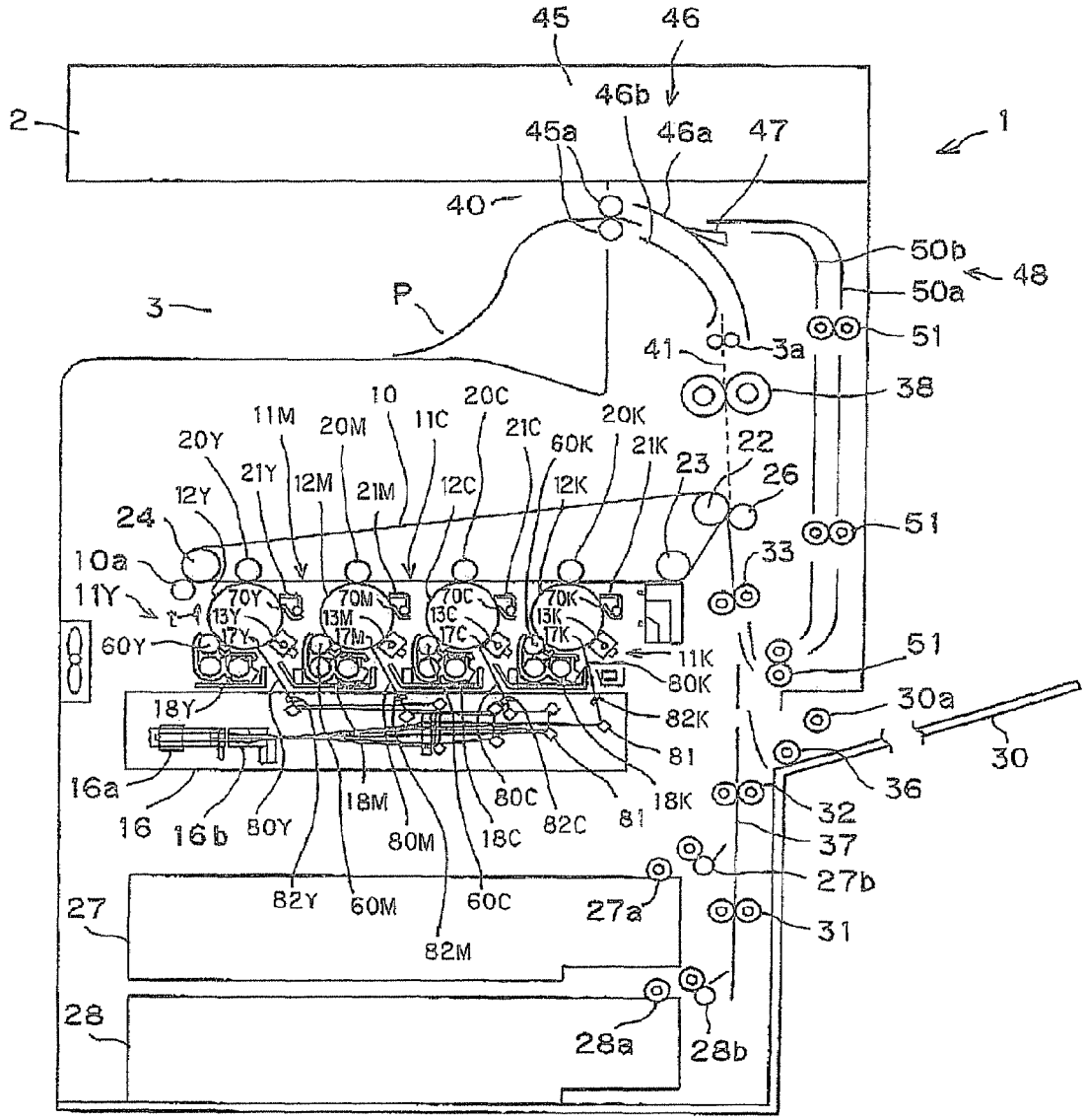
FIG. 1 is a schematic configuration view showing a color copying machine according to an embodiment of the present invention.

Throughout this description, the embodiments and examples shown should be considered as exemplars, rather than limitations on the apparatus and methods of the present invention.

Now, embodiments of the present invention will be described with reference to the accompanying drawings, in which like reference characters denotes like parts in the various views. Overlapping descriptions will be omitted.

FIG. 1 is a schematic configuration view showing a 4-unit tandem color copying machine 1 which is an embodiment of the present invention and is an image forming apparatus. As shown in FIG. 1, the color copying machine 1 comprises a scanner section 2 and an intra-trunk paper delivery section 3 arranged in an upper part thereof. The color copying machine 1 further comprises four image forming units 11K to 11C arranged in parallel below an intermediate transfer belt 10, which is an intermediate transfer medium.

The image forming units 11K to 11C have respective photosensitive drums 12K to 12C that are image bearing members. The intermediate transfer belt 10 is made of a stable material in terms of heat resistance and abrasion resistance, which may typically be a semiconducting polyimide. The intermediate transfer belt 10 is wound around a drive roller 22 and follower rollers 23, 24, and is opposed and brought into contact with each of the photosensitive drums 12K to 12C above the image forming units 11K to 11C. A primary transfer voltage in the order of +1000V is applied to the intermediate transfer belt 10 at the primary transfer positions thereof where it faces the photosensitive drums 12K to 12C. As a result, the toner images on the photosensitive drums 12K to 12C are transferred onto the intermediate transfer belt 10 in a primary transfer operation.

A secondary transfer roller 26 is arranged vis-à-vis the intermediate transfer belt 10 at the secondary transfer position where it is supported by the drive roller 22 around which the intermediate transfer belt 10 is wound. A secondary transfer voltage in the order of about +1,000 V is applied at the secondary transfer position by means of the secondary transfer roller 26 and by way of a sheet of paper P. As a result, the toner image on the intermediate transfer belt 10 is transferred onto the sheet of paper P in a secondary transfer operation. A belt cleaner 10*a* is arranged at a downstream position of the intermediate transfer belt 10 relative to the secondary transfer roller 26.

In each of the image forming units 11K to 11C, electric chargers 13K to 13C as charging means, exposure positions 17K to 17C, development apparatus 18K to 18C as developing means, primary transfer rollers 20K to 20C and cleaning apparatus 21K to 21C as cleaning means are arranged respectively around the photosensitive drums 12K to 12C along the rotation direction thereof as indicated by an arrow t.

The image forming units 11K to 11C can be drawn out to the front side (operator side) of the main body of the color copying machine 1. Driving systems of the photosensitive drums 12K to 12C, electric chargers 13K to 13C, exposure positions 17K to 17C and development apparatus 18K to 18C are mounted on the rear side (opposite side of the operator) of the main body.

The exposure positions 17K to 17C form latent images on the photosensitive drums 12K to 12C based on the image data from a scanner unit 2 by means of the respective colors of laser beams 80K to 80C irradiated from a laser exposure apparatus 16 as an exposure means arranged below the image forming units 11K to 11C. The electric chargers 13K to 13C of the respective image forming units 11K to 11C uniformly charge the surfaces of the photosensitive drums 12K to 12C with electricity to about −700V, for example. The development apparatus 18K to 18C supply the photosensitive drums 12K to 12C with 2-ingredient development agents containing black (K), yellow (Y), magenta (M) and cyan (C) toners and carrier by means of development rollers 60K to 60C as development members to which a development bias voltage in the order of −500 V is applied.

The cleaning apparatus 21K to 21C respectively remove the residual toners on the surfaces of the photosensitive drums 12K to 12C by means of cleaning blades 70K to 70C. The laser exposure apparatus 16 scans the photosensitive drums 12K to 12C in the axial directions via a polygon mirror 16*a* by means of the laser beams emitted from a semiconductor laser element to from images on the respective photosensitive drums 12K to 12C by way of a focusing lens system 16*b* and respective mirrors 81. Cover glasses 82K to 82C are provided at the emission portions of respective colors of the laser beams 80K to 80C of the laser exposure apparatus 16.

Below the laser exposure apparatus 16 of the color image forming apparatus 1 there are provided first and second cassette paper feeders 27 and 28 for feeding a sheet of paper P toward the secondary transfer roller 26. On the right side of the color image forming apparatus 1 there is provided a manual paper feed tray 30 for feeding a sheet of paper P manually. Between the first and second cassette paper feeders 27 and 28 and the second transfer roller 26 there are provided pick-up rollers 27*a* and 28*a* for taking out a sheet of paper P in the first and second cassette paper feeders 27 and 28, separating rollers 27*b* and 28*b*, first and second conveyance rollers 31 and 32, and a resist roller 33. Between the manual paper feed tray 30 and the resist roller 33 there are provided a pick-up roller 30*a* for taking out a sheet of paper P and a manual paper feed roller 36.

Along a longitudinal passage 37 for conveying sheets of paper P fed from the paper feed cassettes 27 and 28 or the manual paper feed tray 30 in a vertical direction, there is provided a fixing apparatus 38 at a downstream portion of the secondary transfer roller 26.

On the upper surface of the paper delivery section 3 there is provided a reversal area 40 as a reversal section substantially parallel to the paper delivery section 3. In a delivered paper conveyance passage 41 extending from the fixing apparatus 38 to the paper delivery section 3 there is provided a paper discharge roller 3*a*. A reversal conveyance unit 45 extending from the fixing apparatus 38 to the reversal area 40 includes a reversal conveyance passage 46 and a switchback roller 45*a*.

The reversal conveyance passage 46 is provided with reversal guides 46*a* and 46*b* and a gate 47. The switch-back roller 45*a* is provided at the inlet of the reversal area 40 and rotates in a forward rotation direction in which a sheet of paper P is conveyed into the reversal area 40 and in a reversal rotation direction in which a sheet of paper P is taken out from the reversal area 40 to a re-conveyance unit 48 side. The gate 47 guides a sheet of paper P from the reversal area 40 to the re-conveyance unit 48 side. The re-conveyance unit 48 includes re-conveyance guides 50*a* and 50*b* and a re-conveyance roller 51 which guide a sheet of paper P in the direction of the secondary transfer roller 26.

Figure 2:
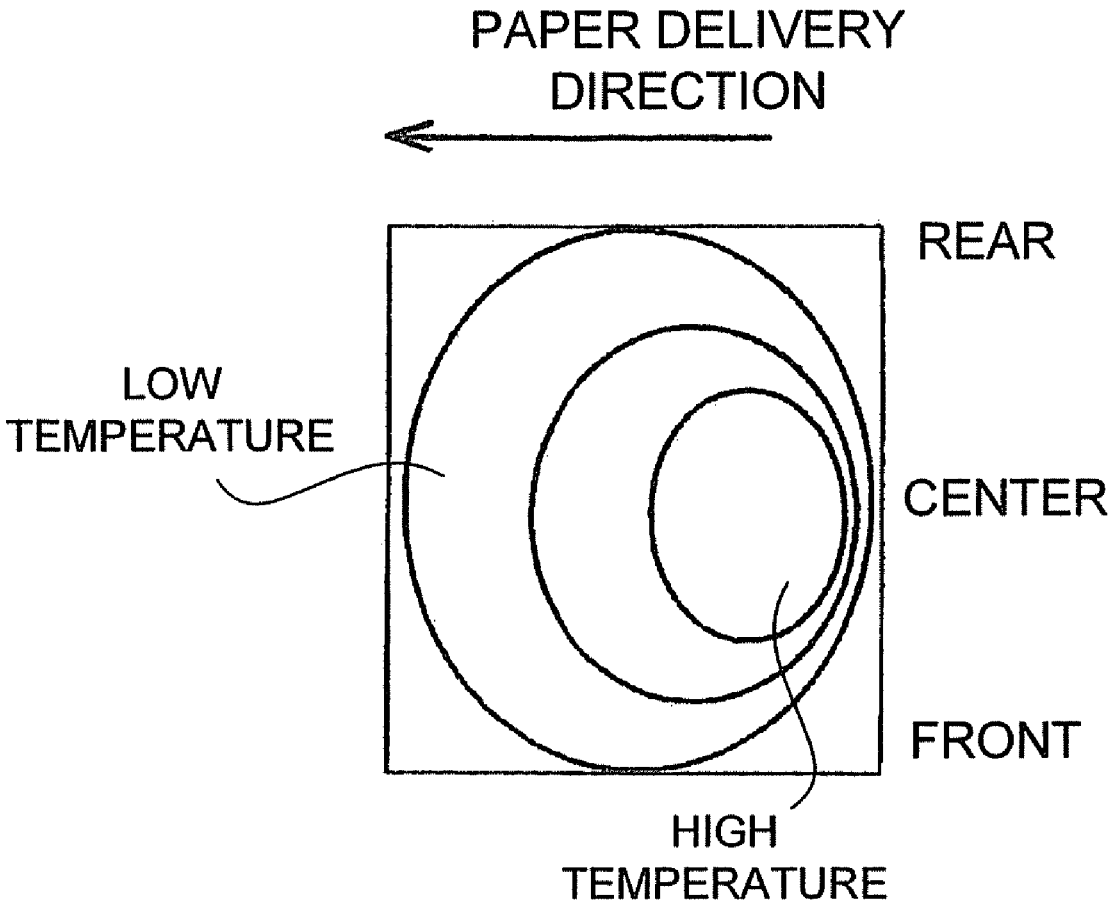
FIG. 2 is a schematic view showing the temperature distribution of a sheet of paper delivered from the fixing unit.

FIG. 2 is a schematic view showing the temperature distribution of a sheet of paper delivered from the fixing unit incorporated in the present image forming apparatus. The horizontal direction of FIG. 2 represents the delivery direction of paper, and the vertical direction thereof represents the front side as a handling area of a user and the rear side distant from the handling area of a user respectively.

As shown in FIG. 2, the temperature is the highest on the rear end side (to the paper delivery direction) and in the vicinity of the center thereof immediately after having been delivered from the high-temperature fixing unit, and becomes lower toward the front end of paper with time after the paper has been delivered from the fixing unit. The temperature distributions on the front side and the rear side are axisymmetrical to each other with respect to the center line of the paper.

Depending on a fixing method, the temperature distribution is different. However, in order to cool the entire sheet of paper to be delivered to realize an equal temperature distribution, high temperature portions must be cooled preferentially.

Figure 3:
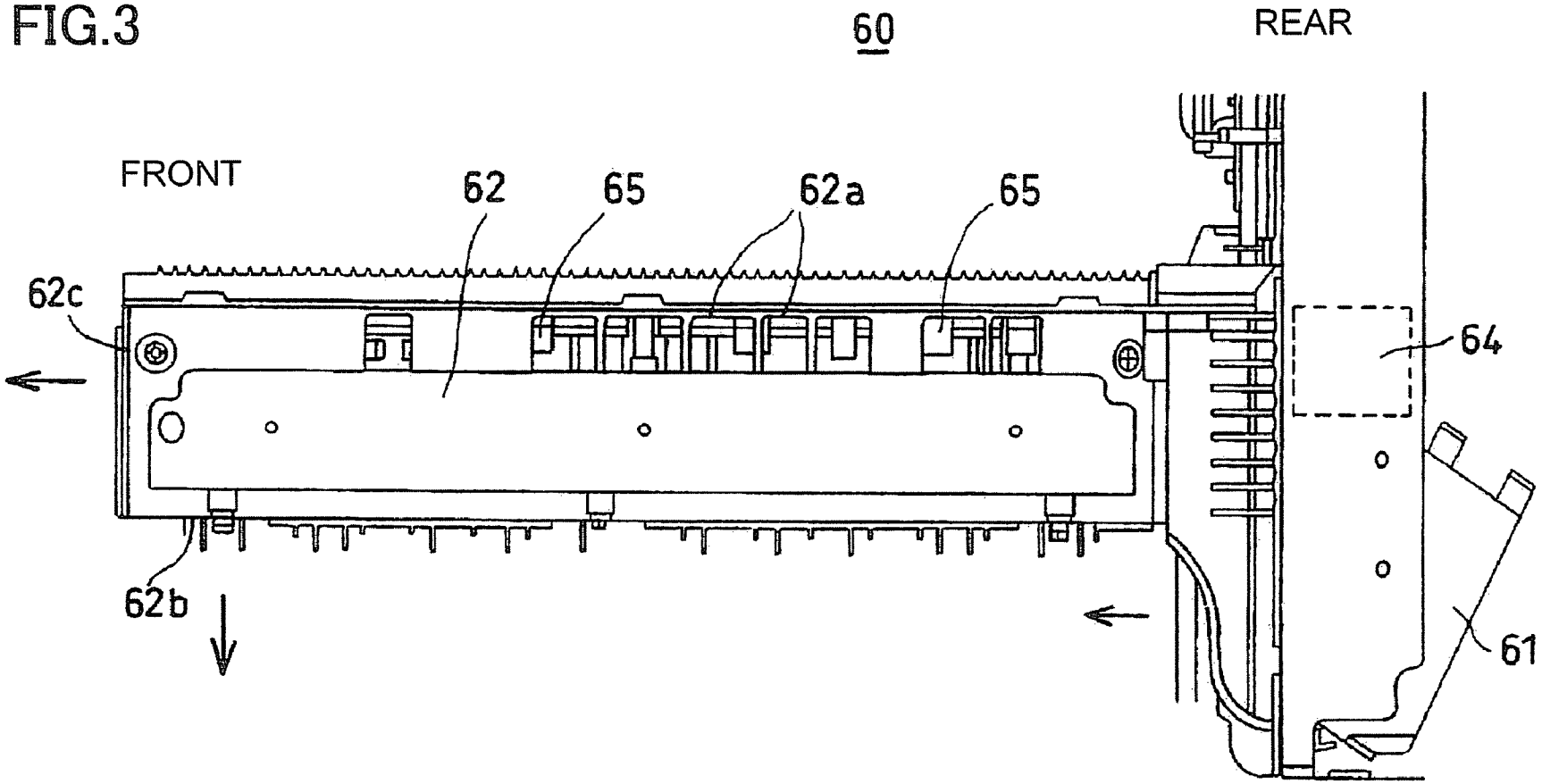
FIG. 3 is a view showing the outline of a cooling mechanism.
Figure 4:
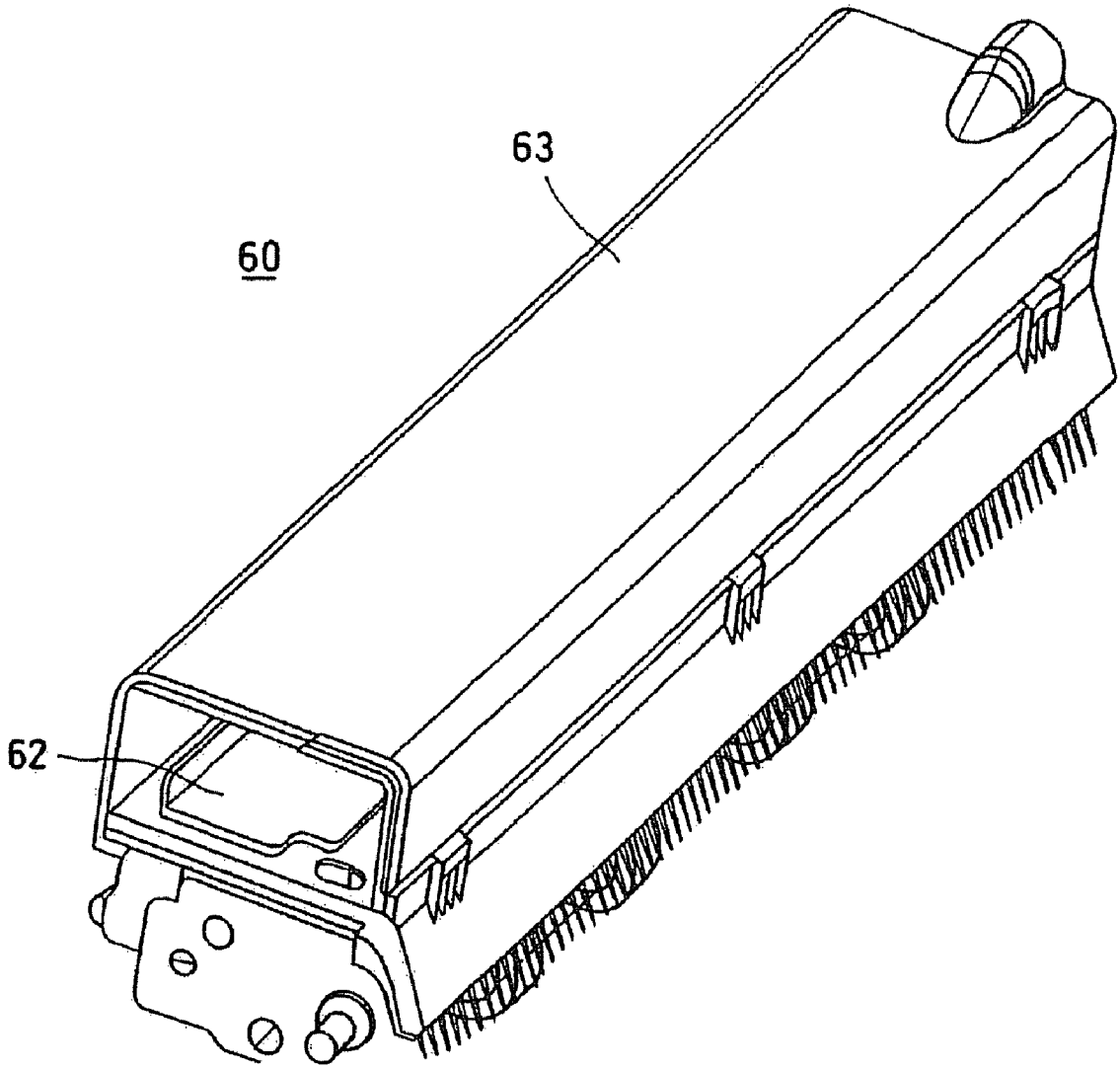
FIG. 4 is a view showing the outline of a cooling mechanism.

FIGS. 3 and 4 are views showing an outline of a cooling mechanism 60 according to the present embodiment. The cooling mechanism 60 comprises an air-cooling fan 61 and a cooling duct 62 for guiding cooling air from the air-cooling fan 61 to desired cooling positions. In this cooling mechanism 60, after having formed an image, cooling airflow is controlled corresponding to the temperature distribution of a delivered sheet of paper. FIG. 4 shows a state in which a cover 63 is attached to the cooling duct 62. FIG. 3 shows a state in which the cover 63 is removed. The air-cooling fan 61 is mounted on the rear side, that is, in a position distant from the operator side of the image forming apparatus. The air-cooling fan 61 is preferably located below a paper delivery motor 64 for driving a paper delivery roller 65 mounted in the fixing unit as shown in FIG. 3. Obliquely below the fixing unit there is mounted an automatic double face printing unit (hereinafter, referred to as ADU). For double face printing, a sheet of paper passes through the fixing unit twice, making the sheet of paper hotter than for single face printing.

As described above, in the vicinity of the fixing unit, in particular, the delivered sheet of paper, the ADU and the control panel become hot, and further, users are very likely to come in touch with these portions. In a view of a user-friendly apparatus, cooling must be performed preferentially in this order.

Generally, the cooling capacity depends on the product of airflow and flow rate. Therefore, for example, the distribution rate of cooling air is preferably set to 60% for the sheet of paper to be delivered, 30% for the ADU and 10% for the control panel. In the present embodiment, the cooling duct 62 receiving cooling air from the air-cooling fan 61 and guiding the air from the rear side to the front side is mounted above the fixing unit (not shown). Accordingly, the cooling duct 62 is substantially orthogonal to the delivery direction of a sheet of paper drawn out from the fixing unit.

The cooling duct 62 is formed, for example, in a shape of a rectangular tube, enabling the cooling positions to be altered by changing the position of the air discharge port. By altering the size of the air discharge port and the flow passage, airflow can be varied. Thus, cooling air can be supplied preferentially to the particular portions where users are very likely to handle.

Figure 5:
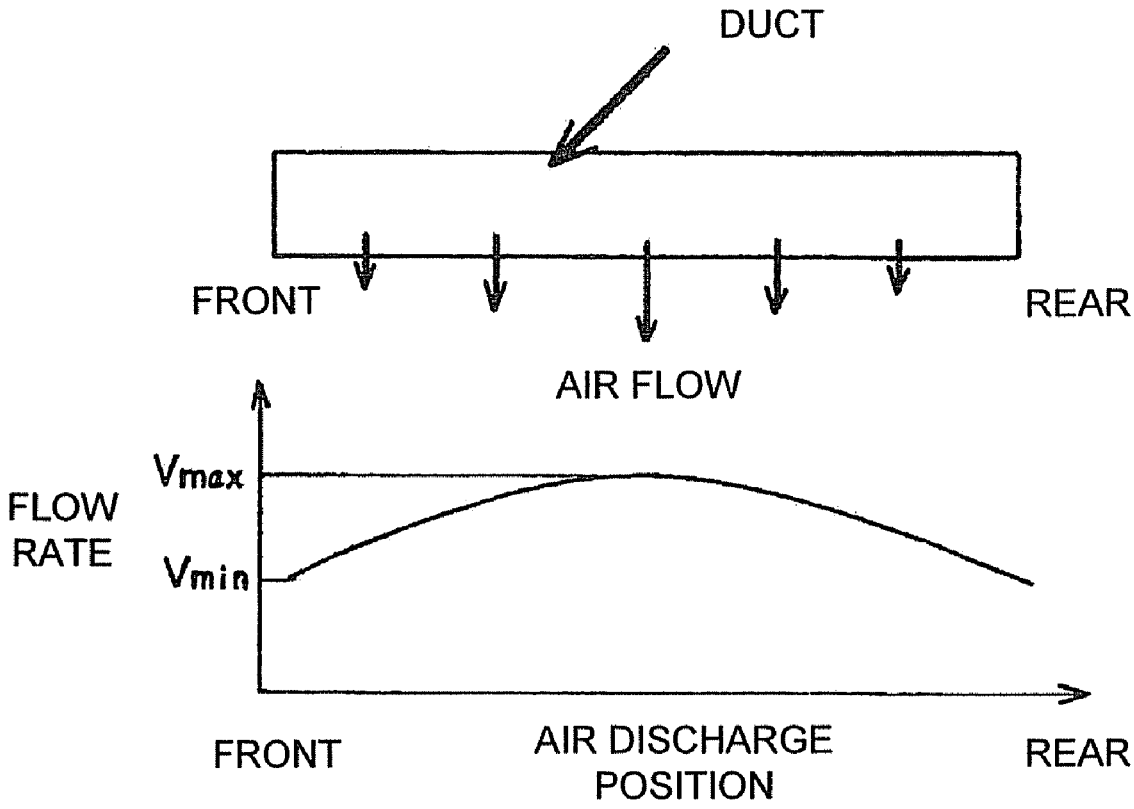
FIG. 5 is a view showing the relationship between the exhaust position of a cooling duct and the flow rate of cooling air.

FIG. 5 shows a relationship between the air discharge position of the cooling duct and the flow rate of cooling air. On the front side, that is, in the air discharge position near the operator side of the image forming apparatus, the flow rate is small, and the flow rate is the largest in the vicinity of the center of the sheet of paper.

As shown in FIG. 3, a plurality of rectangular holes 62*a* are formed in the longitudinal direction of the cooling duct 62. Below these rectangular holes 62*a*, paper delivery rollers 65 are arranged. In order to cool a sheet of paper to be delivered effectively by blowing cooling air to the paper delivery rollers 65, cooling air flows preferably in an arc-like shape in the cooling duct 62. So, the positions of the rectangular holes 62*a* are not located directly above the respective paper delivery rollers 65 and are slightly shifted from the paper delivery rollers 65 toward the rear side.

On the front side of the cooling duct 62 there are formed an opening 62*b* for discharging cooling air toward the ADU and an opening 62*c* for discharging cooling air toward the rear side of the control panel (not shown) operated by a user.

According to the measurement data of the present inventor, by letting the maximum value of the flow rate shown in FIG. 5 be Vmax and the minimum value thereof be Vmin, it was found out that these two values are preferably in good agreement with the relationships given by the following formulas:

$$V\max \geqq 1.2 \times V\min \quad (1)$$

$$V\max \leqq 6 \text{ m/s} \quad (2)$$

By satisfying these conditions, a sheet of paper to be delivered can be cooled effectively. For example, a sheet of paper after single face printing can be cooled equal to or less than 70° C. and a sheet of paper after a double face printing can be cooled equal to or less than 75° C. These temperatures do not result in significant discomfort in handling by users. If the maximum flow rate falls within the above-described range, the alignment of sheets of paper can be ensured.

According to the present embodiment described above, cooling air can be supplied to a plurality of portions where users are very likely to handle, and a plurality of positions can be cooled concurrently.

In addition, since the cooling mechanism is composed of a cooling fan and a cooling duct, the driving motor of the paper delivery section mounted on the rear side can be cooled, thereby enabling delivered sheets of paper further to be cooled by using the waste heat thereof.

Although an exemplary embodiment of the present invention has been shown and described, it will be apparent to those having ordinary skill in the art that a number of changes, modifications, or alternations to the invention as described herein may be made, none of which depart from the spirit of the present invention. All such changes, modifications, and alternations should therefore be seen as within the scope of the present invention.

What is claimed is:

1. An image forming apparatus comprising:

an air-cooling fan; and a cooling duct which guides cooling air from the air-cooling fan to desired positions to be cooled, wherein a discharge port of the cooling duct for blowing cooling air to a sheet of paper to be delivered on which an image has been formed is formed large in the vicinity of the center of the paper width and is formed small in the vicinity of the both ends of the paper width;

the cooling airflow is controlled so the cooling air blown to the sheet of paper to be delivered to exhibit a maximum flow rate in the vicinity of the center of the paper width and a minimum flow rate in the vicinity of both ends of the paper width; and wherein the maximum flow rate Vmax and the minimum flow rate Vmin of the cooling air exhibit the relationships of:

$$V\max \geqq 1.2 \times V\min; \text{ and}$$

$$V\max \leqq 6 \text{ m/s}.$$

2. An image forming apparatus according comprising:

an air-cooling fan; and a cooling duct which guides cooling air from the air-cooling fan to desired position to be cooled, wherein a discharge port of the cooling duct blowing cooling air to a sheet of paper to be delivered on which an image has been formed is formed large in the vicinity of the center of the paper width and is formed small in the vicinty of the both ends of the paper width, and the distribution is set to 60% for the sheet of paper to be delivered, 30% for an automatic double face printing unit and 10% for a control panel.

3. An image forming apparatus comprising:

an air-cooling fan; and a cooling duct which guides cooling air from the air-cooling fan to desired positions to be cooled, wherein a discharge port of the cooling duct for blowing cooling air to a sheet of paper to be delivered on which an image has been formed is formed large in the vicinity of the center of the paper width and is formed small in the vicinity of the both ends of the paper width, and the air-cooling fan is located below a paper delivery motor for driving a paper delivery roller delivering a sheet of paper on which an image has been formed.

4. The image forming apparatus according to claim 3, wherein cooling airflow is controlled so as a cooling air blown to the sheet of paper to be delivered to exhibit a maximum flow rate in the vicinity of the center of the paper width and minimum flow rate in the vicinity of the both ends of the paper width.

5. The image forming apparatus according to claim 3, wherein cooling air is distributed preferentially to predetermined portions where users are very likely to handle.

6. The image forming apparatus according to claim 3, wherein the air-cooling fan is mounted in a position distant from an operator side of the image forming apparatus.

7. The image forming apparatus according to claim 3, wherein the cooling duct is arranged substantially orthogonal to the paper delivery direction of a sheet of paper to be delivered on which an image has been formed.

8. An image forming apparatus comprising:

an air-cooling fan; and a cooling duct which guides cooling air from the air-cooling fan to desired positons to be cooled, wherein a discharge port of the cooling duct for blowing cooling air to a sheet of paper to be delivered on which an image has been formed is formed large in the vicinity of the center of the paper width and is formed small in the vicinity of the both ends of the paper width, and the cooling duct is formed in a shape of tube of which cross section is rectangular, and a plurality of rectangular holes acting as discharge ports of the cooling air are formed in a longitudinal direction thereof.

9. The image forming apparatus according to claim 8, wherein positions of the rectangular holes are not located directly above paper delivery rollers and are shifted from the paper delivery rollers toward the side opposite to an operator side of the image forming apparatus.

* * * * *